US007896698B2

(12) United States Patent
Trout et al.

(10) Patent No.: US 7,896,698 B2
(45) Date of Patent: Mar. 1, 2011

(54) CONNECTOR ASSEMBLY HAVING MULTIPLE CONTACT ARRANGEMENTS

(75) Inventors: David Allison Trout, Lancaster, PA (US); James Lee Fedder, Etters, PA (US); Juli S. Olenick, Fort Worth, FL (US); Steven J. Millard, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 24 days.

(21) Appl. No.: 12/352,159

(22) Filed: Jan. 12, 2009

(65) Prior Publication Data

US 2010/0093195 A1 Apr. 15, 2010

Related U.S. Application Data

(63) Continuation-in-part of application No. 12/250,198, filed on Oct. 13, 2008.

(51) Int. Cl.
*H01R 13/648* (2006.01)

(52) U.S. Cl. ..... 439/607.1

(58) Field of Classification Search ..... 439/607.1, 439/607.9, 607.11, 607.7, 607.5, 63, 924.1, 439/941, 581, 74
See application file for complete search history.

(56) References Cited

U.S. PATENT DOCUMENTS 4,012,093 A 3/1977 Crane
4,012,095 A * 3/1977 Doucet et al. ..... 439/63
4,085,990 A 4/1978 Jayne
4,428,632 A * 1/1984 Rich ..... 439/63
4,518,210 A 5/1985 Morrison
4,603,928 A 8/1986 Evans
4,626,056 A 12/1986 Andrews, Jr. et al.
4,629,270 A 12/1986 Andrews, Jr. et al.
4,695,522 A 9/1987 Nalewajek et al.
4,731,698 A 3/1988 Millot et al.
4,840,569 A 6/1989 Cabourne
4,895,521 A * 1/1990 Grabbe ..... 439/63
4,895,522 A * 1/1990 Grabbe et al. ..... 439/63
5,092,781 A 3/1992 Casciotti et al.
5,102,342 A 4/1992 Marian
5,171,154 A 12/1992 Casciotti et al.
5,228,863 A 7/1993 Campbell et al.
5,399,104 A * 3/1995 Middlehurst et al. ... 439/607.14
5,441,424 A * 8/1995 Morlion et al. ..... 439/581
5,527,189 A * 6/1996 Middlehurst et al. ... 439/607.14

(Continued)

FOREIGN PATENT DOCUMENTS

EP 0459356 8/1995

OTHER PUBLICATIONS

Neoconix PCBeam™ Interposer Design Guide, Neoconix, Rev. 070925, 4 pgs.

*Primary Examiner*—T C Patel
*Assistant Examiner*—Vladimir Imas

(57) ABSTRACT

A connector assembly includes a housing and substantially identical contacts. The housing is configured to mate with a mating connector. The contacts are arranged in a plurality of sets in the housing. The contacts are configured to electrically couple with the mating connector. Each set of contacts is arranged to communicate a different type of data signal with the mating connector. Optionally the contacts are formed as substantially identical pins. The different sets of contacts may concurrently communicate the different types of data signals.

9 Claims, 7 Drawing Sheets

U.S. PATENT DOCUMENTS 5,554,038 A 9/1996 Morlion et al.
5,567,166 A * 10/1996 Lemke ..... 439/74
5,772,451 A 6/1998 Dozier, II et al.
RE36,065 E * 1/1999 Andrews et al. ..... 439/607.11
5,904,581 A 5/1999 Pope et al.
6,027,345 A 2/2000 McHugh et al.
6,062,872 A 5/2000 Strange et al.
6,077,090 A 6/2000 Campbell et al.
6,083,047 A 7/2000 Paagman
6,116,965 A 9/2000 Arnett et al.
6,135,781 A 10/2000 Pope et al.
6,179,663 B1 * 1/2001 Bradley et al. ..... 439/607.02
6,231,391 B1 5/2001 Ramey
6,267,625 B1 * 7/2001 Gugliotti et al. ..... 439/607.07
6,310,286 B1 10/2001 Troxel et al.
6,394,822 B1 5/2002 McNamara
6,411,517 B1 6/2002 Babin
6,443,745 B1 * 9/2002 Ellis et al. ..... 439/101
6,461,202 B2 10/2002 Kline
6,537,087 B2 * 3/2003 McNamara et al. ..... 439/108
6,551,140 B2 4/2003 Billman et al.
6,623,280 B2 9/2003 Oldenburg et al.
6,672,878 B2 1/2004 Dean
6,682,368 B2 1/2004 Murr et al.
6,695,646 B1 2/2004 Grabbe
6,699,048 B2 3/2004 Johnson et al.
6,705,895 B2 3/2004 Hasircoglu
6,712,620 B1 3/2004 Li et al.
6,739,910 B1 5/2004 Wu
6,743,049 B2 6/2004 Perugini et al.
6,743,057 B2 6/2004 Davis et al.
6,809,255 B1 10/2004 Chun
6,866,521 B1 3/2005 Harper, Jr.
6,872,085 B1 * 3/2005 Cohen et al. ..... 439/108
6,875,056 B1 4/2005 Bianchini et al.
6,899,550 B2 * 5/2005 Perugini et al. ..... 439/74
6,902,416 B2 6/2005 Feldman
6,917,525 B2 * 7/2005 Mok et al. ..... 361/767
6,918,776 B2 * 7/2005 Spink, Jr. ..... 439/74
6,932,618 B1 * 8/2005 Nelson ..... 439/66
6,932,655 B2 8/2005 Hatterscheid et al.
6,945,788 B2 9/2005 Trout et al.
6,951,482 B1 * 10/2005 Miller et al. ..... 439/581
6,960,103 B2 * 11/2005 Tokunaga ..... 439/607.13
7,018,239 B2 3/2006 Zaderej et al.
7,021,945 B2 * 4/2006 Perugini et al. ..... 439/74
7,044,746 B2 5/2006 Copper et al.
7,083,428 B1 * 8/2006 Mahoney et al. ..... 439/70
7,086,872 B2 8/2006 Myer et al.
7,086,913 B2 8/2006 Myer et al.
7,097,465 B1 * 8/2006 Korsunsky et al. ..... 439/74
7,097,470 B2 * 8/2006 Harper, Jr. ..... 439/83
7,114,961 B2 10/2006 Williams
7,137,832 B2 * 11/2006 Mongold et al. ..... 439/108
7,179,095 B1 * 2/2007 Peng et al. ..... 439/74
7,180,318 B1 * 2/2007 Mahoney et al. ..... 324/761
7,207,807 B2 4/2007 Fogg
7,244,125 B2 * 7/2007 Brown et al. ..... 439/66
7,262,672 B2 * 8/2007 Lee et al. ..... 333/33
7,297,015 B1 11/2007 Desrosiers et al.
7,309,239 B2 * 12/2007 Shuey et al. ..... 439/74
7,331,830 B2 * 2/2008 Minich ..... 439/857
7,374,441 B2 5/2008 Rubenstein
7,390,194 B1 6/2008 Crippen et al.
7,419,400 B1 9/2008 Taylor et al.
7,425,134 B1 9/2008 Taylor
7,429,176 B2 * 9/2008 Johnescu et al. ..... 439/74
7,438,582 B2 10/2008 Taylor
7,465,195 B1 12/2008 Kerrigan et al.
7,470,149 B2 * 12/2008 Kazama et al. ..... 439/607.05
2001/0049207 A1 12/2001 Sakata et al.
2002/0151218 A1 10/2002 Figueroa et al.
2003/0277439 2/2003 Johnescu et al.
2003/0064614 A1 4/2003 Tanaka et al.
2003/0082954 A1 5/2003 Espenshade et al.
2003/0162442 A1 8/2003 Panella
2004/0161954 A1 * 8/2004 Johnescu et al. ..... 439/74
2004/0166704 A1 * 8/2004 Perugini et al. ..... 439/74
2004/0174223 A1 9/2004 Achyut
2005/0032437 A1 * 2/2005 Johnescu et al. ..... 439/701
2005/0208828 A1 9/2005 Miller et al.
2005/0250387 A1 * 11/2005 Brunker et al. ..... 439/637
2005/0277315 A1 * 12/2005 Mongold et al. ..... 439/108
2005/0287850 A1 * 12/2005 Minich et al. ..... 439/108
2006/0019517 A1 * 1/2006 Raistrick et al. ..... 439/108
2006/0035530 A1 * 2/2006 Shuey et al. ..... 439/701
2006/0160428 A1 * 7/2006 Hashim ..... 439/676
2006/0240688 A1 * 10/2006 Perugini et al. ..... 439/74
2006/0246756 A1 * 11/2006 Winings et al. ..... 439/108
2006/0292898 A1 * 12/2006 Meredith et al. ..... 439/65
2006/0292921 A1 * 12/2006 Dahms et al. ..... 439/437
2007/0021001 A1 * 1/2007 Laurx et al. ..... 439/608
2007/0059952 A1 * 3/2007 Raistrick et al. ..... 439/74
2007/0097662 A1 5/2007 Dean
2007/0099455 A1 * 5/2007 Rothermel et al. ..... 439/108
2007/0111560 A1 * 5/2007 Kazama et al. ..... 439/71
2007/0190825 A1 8/2007 Shuey et al.
2007/0197095 A1 * 8/2007 Feldman et al. ..... 439/608
2008/0026608 A1 1/2008 Sano et al.
2008/0032524 A1 2/2008 Lemke et al.
2008/0096433 A1 * 4/2008 Bixler et al. ..... 439/637
2008/0188098 A1 * 8/2008 Boesch et al. ..... 439/74
2008/0214059 A1 9/2008 Rothermel et al.
2008/0220630 A1 * 9/2008 Sipe et al. ..... 439/74
2008/0227314 A1 9/2008 Taylor
2008/0233806 A1 9/2008 Rothermel et al.

* cited by examiner

CONNECTOR ASSEMBLY HAVING MULTIPLE CONTACT ARRANGEMENTS

CROSS-REFERENCE TO RELATED APPLICATIONS

This application is a continuation-in-part of copending U.S. patent application Ser. No. 12/250,198 (the '198 Application). The '198 Application was filed on Oct. 13, 2008, and is entitled "Connector Assembly Having Signal And Coaxial Contacts." The complete subject matter of the '198 Application is incorporated by reference herein in its entirety.

BACKGROUND OF THE INVENTION

The invention relates generally to electrical connectors and, more particularly, to a connector assembly that mechanically and electrically connects substrates.

Known mezzanine connector assemblies mechanically and electrically interconnect a pair of circuit boards. The mezzanine connector assemblies engage each of the circuit boards to mechanically interconnect the circuit boards. Signal contacts in the mezzanine connector assemblies mate with the circuit boards and provide an electrical connection between the circuit boards. The signal contacts permit the communication of data or control signals between the circuit boards. The connectors may be configured to communicate a single type of signal using the signal contacts. For example, the signal contacts may be grouped in a grid to communicate a signal such as a differential pair signal. In order to also communicate a different type of signal, the connectors may include different signal contacts. For example, the connectors may include coaxial contacts to communicate radio frequency ("RF") signals or different signal contacts to communicate a differential pair signal at a different rate or speed. Known connectors thus require several different types of signal contacts to communicate several different types of signals using the same connector. The need for several different types of signal contacts adds to the complexity of the connector.

Thus, a need exists for an improved connector assembly that is capable of communicating several different types or modes of signals without requiring several different types of signal contacts.

BRIEF DESCRIPTION OF THE INVENTION

In one embodiment, a connector assembly includes a housing and substantially identical contacts. The housing is configured to mate with a mating connector. The contacts are arranged in a plurality of sets in the housing. The contacts are configured to electrically couple with the mating connector. Each set of contacts is arranged to communicate a different type of data signal with the mating connector. Optionally the contacts are formed as substantially identical pins. The different sets of contacts may concurrently communicate the different types of data signals.

In another embodiment, a mezzanine connector assembly includes a housing and several contacts. The housing mechanically couples a plurality of substrates in a parallel relationship. The contacts are substantially identical to one another and are arranged in a plurality of sets in the housing. The contacts electrically couple the substrates with one another. Each of the sets of contacts is arranged to communicate a different type of data signal between the substrates.

DETAILED DESCRIPTION OF THE INVENTION

Figure 1:
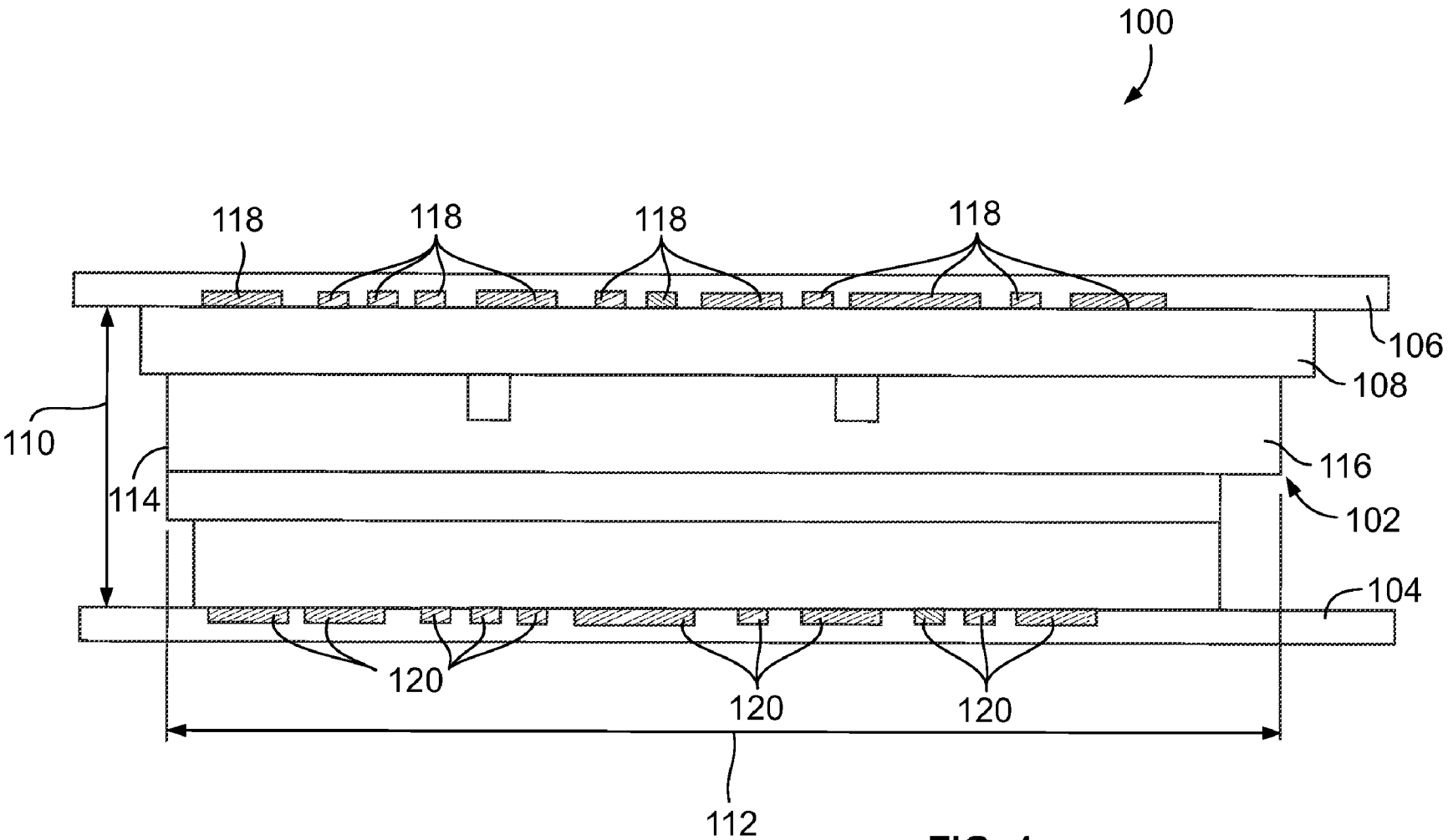
FIG. 1 is an elevational view of a mezzanine connector assembly according to one embodiment.

FIG. 1 is an elevational view of a mezzanine connector assembly 100 according to one embodiment. The connector assembly 100 includes a header assembly 102 and a mating connector 108 that mechanically and electrically connects a plurality of substrates 104, 106 in a parallel arrangement. As shown in FIG. 1, the substrates 104, 106 are interconnected by the connector assembly 100 so that the substrates 104, 106 are substantially parallel to one another. The substrates 104, 106 may include circuit boards. For example, a first, or lower, substrate 104 may be a motherboard and a second, or upper, substrate 106 may be a daughter board. The upper substrate 106 includes conductive pathways 118 and the lower substrate 104 includes conductive pathways 120. The conductive pathways 118, 120 communicate data signals and/or electric power between the substrates 106, 104 and one or more electric components (not shown) that are electrically connected to the substrates 106, 104. The conductive pathways 118, 120 may be embodied in electric traces in a circuit board, although other conductive pathways, contacts, and the like, may be the conductive pathways 118, 120. The terms upper, lower, daughter board and motherboard are used herein to describe the substrates 104, 106 but are not intended to limit the scope of the embodiments described herein. For example, the lower substrate 104 may be disposed above the upper substrate 106 or the substrates 104, 106 may be disposed such that neither is above the other.

The mating connector 108 is mounted to the daughter board 106 in the illustrated embodiment. The header assembly 102 is mounted to the motherboard 104 and mates with the mating connector 108 to electrically and mechanically couple the daughter board 106 and the motherboard 104. In another example, the mating connector 108 is mounted to the motherboard 104. Alternatively, the header assembly 102 may directly mount to each of the daughter board 106 and the motherboard 104 to electrically and mechanically couple the daughter board 106 and the motherboard 104. The daughter board 106 and the motherboard 104 may include electrical components (not shown) to enable the connector assembly 100 to perform certain functions. For purposes of illustration only, the connector assembly 100 may be a blade for use in a blade server. It is to be understood, however, that other applications of the inventive concepts herein are also contemplated.

The header assembly 102 separates the daughter board 106 and the motherboard 104 by a stack height 110. The stack height 110 may be approximately constant over an outer length 112 of the header assembly 102. The outer length 112 extends between opposing outer ends 114, 116 of the header assembly 102. Alternatively, the stack height 110 may differ or change along the outer length 112 of the header assembly 102. For example, the header assembly 102 may be shaped such that the daughter board 106 and the motherboard 104 are disposed transverse to one another. The stack height 110 may be varied by connecting the daughter board 106 and the motherboard 104 using different header assemblies 102 and/or mating connectors 108. The sizes of the header assembly 102 and/or the mating connector 108 may vary so that the stack height 110 may be selected by an operator. For example, an operator may select one header assembly 102 and/or mating connector 108 to separate the daughter board 106 and the motherboard 104 by a desired stack height 110.

Figure 2:
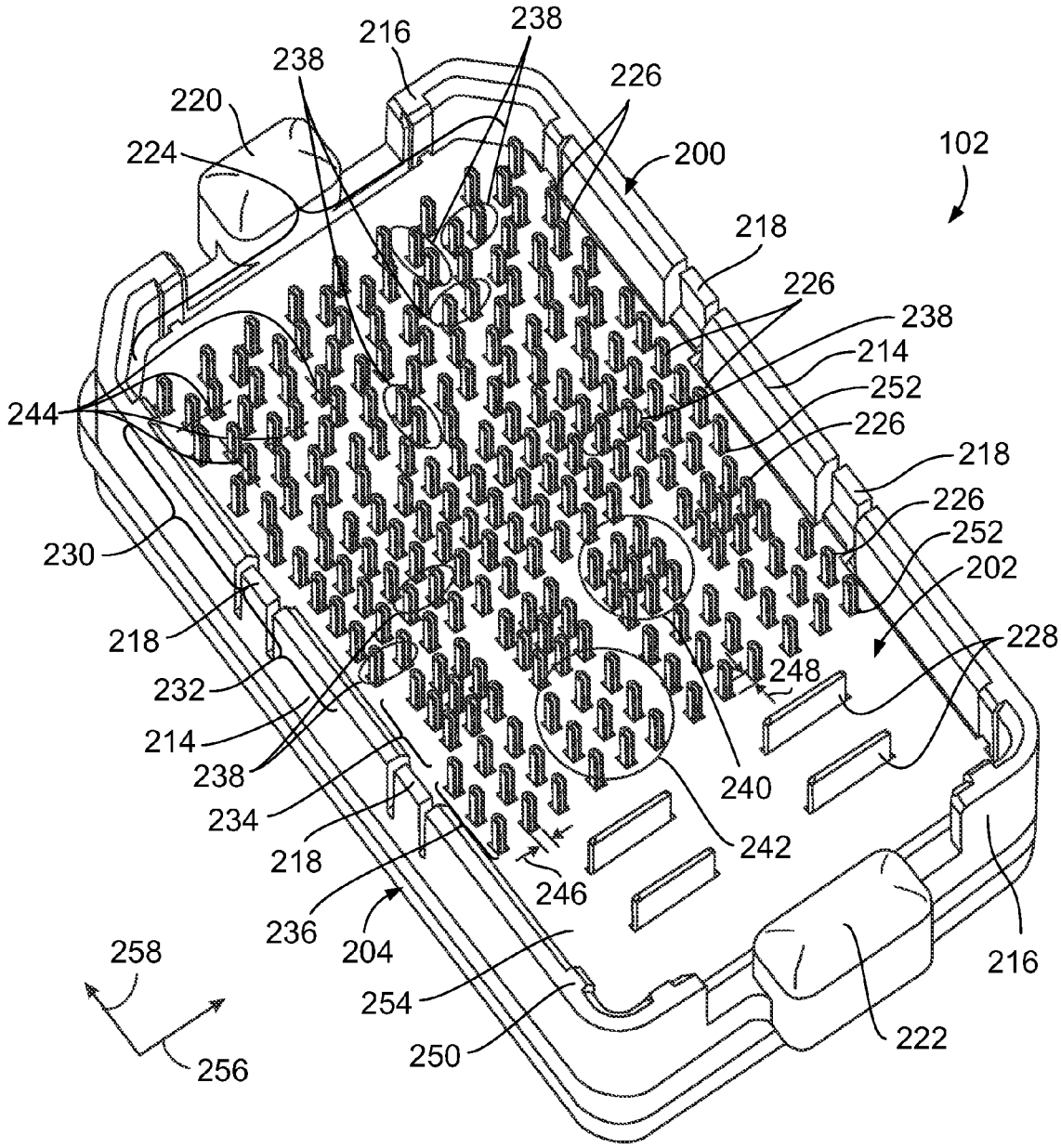
FIG. 2 is a perspective view of a header assembly shown in FIG. 1.

FIG. 2 is a perspective view of the header assembly 102. The header assembly 102 includes a housing 200 that extends between a mating face 250 and a mounting interface 204. The housing 200 may be a unitary body. For example, the housing 200 may be homogeneously formed as a unitary body. The housing 200 may be formed from, or include, a dielectric material. The header assembly 102 includes a contact organizer 202 that is held proximate to the mating face 250 of the header assembly 102. The contact organizer 202 may be homogeneously formed as a unitary body. The contact organizer 202 may be formed from, or include, a dielectric material. The contact organizer 202 is at least partially bounded by plurality of sidewalls 214 and a plurality of end walls 216.

The sidewalls and end walls 214, 216 protrude from the contact organizer 202 in a direction transverse to an upper surface 254 of the contact organizer 202. The sidewalls 214 and end walls 216 form a shroud in which at least a portion of the mating connector 108 is received when the header assembly 102 and the mating connector 108 mate with one another. The sidewalls 214 include latches 218 in the illustrated embodiment. The latches 218 may retain the contact organizer 202 between the sidewalls 214 and end walls 216 to prevent the contact organizer 202 from being removed from the header assembly 102 through the mating face 250. Alternatively, one or more of the end walls 216 may include one or more latches 218.

The end walls 216 include polarization features 220, 222 in the illustrated embodiment. The polarization features 220, 222 are shown as columnar protrusions that extend outward from the end walls 216. The polarization features 220, 222 are received in corresponding polarization slots 508, 510 (shown in FIG. 6) in the mating connector 108 (shown in FIG. 1) to properly orient the header assembly 102 and the mating connector 108 with respect to one another. For example, one polarization feature 222 may be larger than the other polarization feature 220. Each of the slots 508, 510 in the mating connector 108 is shaped to receive a corresponding one of the polarization features 220, 222. As a result, the polarization features 220, 222 and slots 508, 510 permit the header assembly 102 and the mating connector 108 to mate with one another in one a single orientation so that the header assembly 102 and the mating connector 108 are aligned with respect to one another when mated.

The mounting interface 204 mounts to the motherboard 104 (shown in FIG. 1) to electrically and mechanically connect the header assembly 102 with the motherboard 104. The mating face 250 and contact organizer 202 engage the mating connector 108 (shown in FIG. 1) to electrically and mechanically connect the header assembly 102 and the mating connector 108. Alternatively, the mating face 250 may engage the daughter board 106 to electrically and mechanically connect the daughter board 106 with the motherboard 104 (shown in FIG. 1).

The header assembly 102 includes an array 224 of signal contacts 226 and power contacts 228 that extend through the housing 200 and protrude from the mating face 250 and the mounting interface 204. As described below, the signal contacts 226 are substantially identical to one another, but are arranged in several sets 230-236 (shown in FIG. 2) to permit the signal contacts 226 to communicate several different types or modes of data signals. For example, the signal contacts 226 may be provided in different geometric relationships with respect to one another in order to communicate two or more different signal types, such as a differential pair signal, a differential pair signal of a different speed or communication rate, RF signals (or signals typically communicated using coaxial connectors). The different arrangements of the same signal contacts 226 permits a single connector assembly 100 to communicate several different types of data signals using the same signal contacts 226. For example, a single mezzanine connector that houses or holds the signal contacts 226 in a single continuous body without the inclusion of additional connectors not used to mechanically couple a plurality of circuit boards with one another may use the signal contacts 226 to concurrently communicate different types of signals between the circuit boards.

The signal and power contacts 226, 228 extend from the contact organizer 202 through holes 252 to engage the mating connector 108 and from the mounting interface 204 to engage the motherboard 104 (shown in FIG. 1). The signal and power contacts 226, 228 provide electrical connections between the motherboard 104 and the daughter board 106 (shown in FIG. 1). A different number of signal contacts 226 and/or power contacts 228 than those shown in FIG. 2 may be provided. The signal and power contacts 226, 228 extend through the header assembly 102 transverse to the mating face 250 and the mounting interface 204. For example, the signal and power contacts 226, 228 may extend through the header assembly 102 in a perpendicular direction to the mating face 250 and the mounting interface 204.

The power contacts 228 mate with the mating connector 108 (shown in FIG. 1) and the motherboard 104 (shown in FIG. 1) to communicate electric power between the motherboard 104 and the daughter board 106 (shown in FIG. 1). For example, the power contacts 228 may electrically communicate electric current from the motherboard 104 to the daughter board 106. The current may be drawn by electric components (not shown) electrically connected with the daughter board 106 to power the components. In one embodiment the power contacts 228 communicate electric power that is not used to communicate data or information between the daughter board 106 and the motherboard 104.

The signal contacts 226 mate with the mating connector 108 (shown in FIG. 1) and the motherboard 104 (shown in FIG. 1) to communicate two or more different types or modes of data signals between the motherboard 104 and the daughter board 106 (shown in FIG. 1). For example, the signal contacts 226 may electrically communicate information, control signals, data, and the like, between the motherboard 104 and the daughter board 106 in two or more different modes. In the embodiment shown in FIG. 2, the signal contacts 226 are arranged to communicate a first differential pair signal mode using the signal contacts 226 in the first set 230 and a second differential pair signal mode using the signal contacts 226 in the second set 232. The first differential pair signal mode may communicate differential pair signals at a greater rate or speed than the differential pair signals communicated using the second differential pair signal mode. The signal contacts 226 in the third set 234 and in the fourth set 236 are arranged to communicate different signal modes by emulating coaxial connectors having different electrical impedance characteristics. For example, the signal contacts 226 in the third set 234 may emulate coaxial connectors having a lower electrical impedance characteristic than the coaxial connectors in the fourth set 236. In one embodiment, the signal contacts 226 communicate electronic signals that are not used to power any other component (not shown) that is electrically connected to the motherboard 104 or the daughter board 106.

The signal contacts 226 in each set 230-236 are separated from one another in the contact organizer 202. For example, the signal contacts 226 in each set 230-236 are not interspersed among one another in the embodiment shown in FIG. 2. The differential pair pattern in which the signal contacts 226 are arranged in the sets 230, 232 includes the signal contacts 226 arranged in pairs 238. Each pair 238 of signal contacts 226 communicates a differential pair signal. For example, the pairs 238 of signal contacts 226 in the first and second sets 230, 232 may communicate differential pair signals between the daughter board 106 (shown in FIG. 1) and the motherboard 104 (shown in FIG. 1). The signal contacts 226 in the first set 230 may be arranged in a noise-reducing differential signal contact pair as disclosed in co-pending U.S. patent application Ser. No. 12/250,268, entitled "Connector Assembly Having A Noise-Reducing Contact Pattern," and filed Oct. 13, 2008 (the "'268 application"). The signal contacts 226 in each pair 238 in the first set 230 may be oriented along a contact pair line 244. The contact pair lines 244 of adjacent contact pairs 238 are transverse with respect to one another. For example, the contact pair lines 244 of adjacent pairs 238 may be perpendicular to one another. The pairs 238 of signal contacts 226 may be separated from one another by a grid of grounded signal contacts 226. The grid of the grounded signal contacts 226 are arranged in concentric rings 932 having straight lines of the signal contacts 226 representing the rings 932. In the embodiment shown in FIG. 3, the grounded signal contacts 226 include signal contacts 226 that are electrically coupled with an electrical ground. The concentric rings 932 of the grounded signal contacts 226 may reduce cross-talk between the signal contacts 226 arranged in the pairs 238.

The signal contacts 226 in the second set 232 are arranged in a regularly spaced grid. For example, the signal contacts 226 may be spaced apart from one another in first and second directions 256, 258 in the plane of the upper surface 254 of the contact organizer 202. The first and second directions 256, 258 may be transverse to one another in a common plane. For example, the contact organizer 202 may define a plane in which the first and second direction 256, 258 extend in perpendicular directions with respect to one another. The common plane that is defined by the contact organizer 202 is parallel to the planes of the motherboard 104 (shown in FIG. 1) and the daughter board 106 (shown in FIG. 1) in one embodiment. The regularly spaced grid of the signal contacts 226 may permit a variety of uses for the signal contacts 226. For example, some of the signal contacts 226 may be used as ground contacts while other signals contacts 226 are used to communicate data signals. In one embodiment, the signal contacts 226 in the second set 232 are used to communicate signals other than differential pair signals. For example, the signal contacts 226 may communicate data signals other than differential pair signals.

The signal contacts 226 in the third and fourth sets 234, 236 are arranged in groups 240, 242. Each group 240, 242 includes the signal contacts 226 arranged in a coaxial signal contact pattern and is configured to communicate signals in a manner that emulates a coaxial connection. For example, the signal contacts 226 in the coaxial signal contact pattern may emulate a coaxial connector by communicating an RF signal between the motherboard 104 (shown in FIG. 1) and the daughter board 106 (shown in FIG. 1). By way of example only, the groups 240 of signal contacts 226 may emulate a coaxial connector having an impedance of approximately 50 Ohms and the groups 242 of signal contacts 226 may emulate a coaxial connector having an impedance of approximately 75 Ohms. The signal contacts 226 may emulate coaxial connectors having different impedances. As described below with respect to FIGS. 6 and 8, the signal contacts 226 may emulate coaxial connectors Keith different impedance characteristics by increasing or decreasing the spacing between the signal contacts 226.

In one embodiment the signal contacts 226 in each of the sets 230-236 are substantially identical with respect to one another. For example, the same type of contact having substantially similar dimensions and including or formed of the same or similar materials may be used as the signal contacts 226 in each of the sets 230-236. The signal contacts 226 may have a common width 246 in a plane that is parallel to the upper surface 254 of the contact organizer 202. The signal contacts 226 may have a common depth dimension 248 in a direction that is transverse to the direction in which the common width 246 is measured and that is in a plane parallel to the upper surface 254 of the contact organizer 202.

Figure 3:
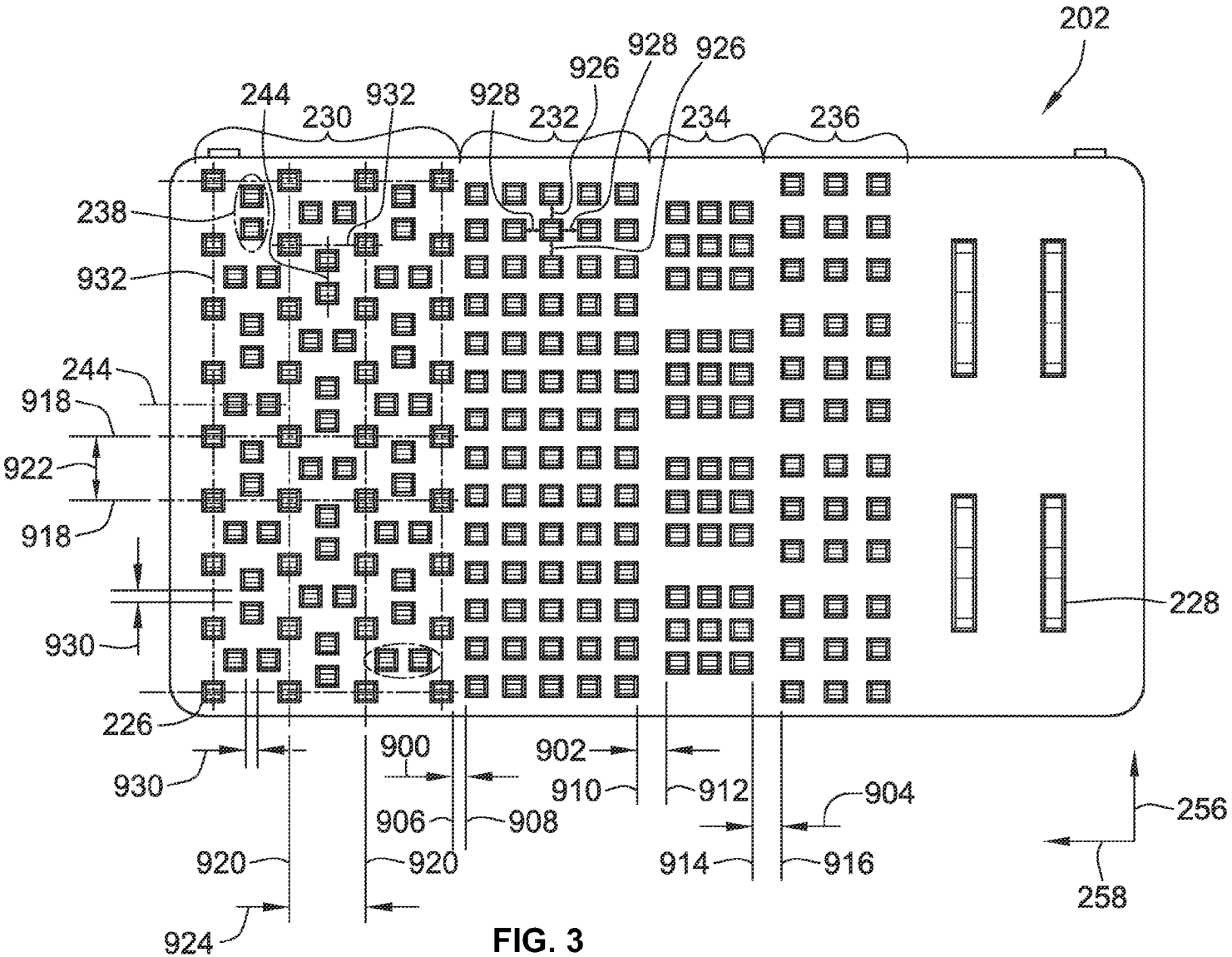
FIG. 3 is a top view of a contact organizer of the mezzanine connector shown in FIG. 1 according to one embodiment.

FIG. 3 is a top view of the contact organizer 202 of the header assembly 102 according to one embodiment. The contact organizer 202 illustrates the relative locations of the contacts 226, 228 and the sets 230-236. The orientation and relative locations of one or more of the contacts 226, 228 and the sets 230-236 may be varied from the embodiment shown in FIG. 3. The contact organizer 202 is elongated in the second direction 258. For example, the contact organizer 202 extends along the second direction 258 a greater distance than the contact organizer 202 extends along the first direction 256.

As described above, the different sets 230-236 of signal contacts 226 may be arranged to communicate different types or modes of data signals using the same signal contacts 226. The type of signal that is communicated using the signal contacts 226 depends on the arrangement of the signal contacts 226. The number and arrangement of the sets 230-236 may be varied to meet the needs of the connector assembly 100. In one embodiment as the same or substantially the same signal contact 226 is used in each set 230-236 and each set 230-236 may communicate a different type of data signal, the number of different types of signal contacts 226 in the connector assembly 100 may be less than the number of types of signals that may be communicated using the signal contacts 226.

Neighboring couples of the sets 230-236 are separated from one another by an intra-set separation distance 900-904. For example, the sets 230, 232 are separated by the intra-set separation distance 900. The sets 232, 234 are separated by the intra-set separation distance 902. The sets 234, 236 are separated by the intra-set separation distance 904. The intra-set separation distances 900-904 may be measured as the distance along the second direction 258 between the closest signal contacts 226 in neighboring couples of the sets 230-236. For example, the intra-set separation distances 900-904 may be the distances between borders 906-916 of the various sets 230-236. The borders 906-916 represent an edge of a corresponding set 230-236 that extends along the first direction 256. The borders 906-916 extend along the outermost signal contacts 226 that are positioned on one side of the corresponding set 230-236. The intra-set separation distances 900-904 may be adjusted to reduce interference between the different sets 230-236 of signal contacts 226. For example, one or more of the intra-set separation distances 900-904 may be increased to reduce the cross-talk between adjacent sets 230-236 of signal contacts 226.

As described above, the signal contacts 226 in the first set 230 are arranged in a differential pair pattern. The signal contacts 226 that are not oriented in differential pairs 238 along contact pair lines 244 may be ground contacts that are electrically coupled to an electric ground of the connector assembly 100 (shown in FIG. 1). The grounded signal contacts 226 in the first set 230 may be oriented along ground lines 918, 920. For example, the grounded signal contacts 226 may be linearly aligned with one another along ground lines 918 that extend along the second direction 258 and along transverse ground lines 920 that extend along the first direction 256. In the illustrated embodiment each grounded signal contact 226 is linearly aligned with several other grounded signal contacts 226 along one of the ground lines 918 and one of the ground lines 920.

The ground lines 918 are separated from one another by a first ground dimension 922 and the ground lines 920 are separated from one another by a second ground dimension 924. The first ground dimension 922 is measured along the first direction 256 and the second ground dimension 924 is measured along the second direction 258. The ground dimensions 922, 924 may differ from one another. For example, the second ground dimension 924 may be greater than the first ground dimension 922. Alternatively the ground dimensions 922, 924 may be approximately the same. The first ground dimension 922 may be approximately the same for each pair of neighboring ground lines 918 and the second ground dimension 924 may be approximately the same for each pair of neighboring ground lines 920. Optionally one or more of the ground dimensions 922, 924 may differ among the corresponding pairs of neighboring ground lines 918, 920. The arrangement of the signal contacts 226 in the first set 230 may be adjusted to manage the electrical impedance characteristic of the signal contacts 226 or to reduce cross-talk among the signal contacts 226. For example, similar to the intra-set separation distances 900-904, one or more of the ground dimensions 922, 924 may be adjusted to change the electrical impedance characteristic of the header assembly 102.

The signal contacts 226 in the differential pairs 238 are separated by an inter-contact separation distance 930. The inter-contact separation distance 930 may be defined as the minimum distance between signal contacts 226 in each pair 238. The inter-contact separation distance 930 may be approximately the same for all pairs 238 or may differ among the pairs 238 in the first set 230. The inter-contact separation distance 930 may be adjusted to change the electrical impedance characteristic of the header assembly 102. For example, the inter-contact separation distance 930 may be increased to increase the electrical impedance of the header assembly 102.

The signal contacts 226 in the second set 232 may be arranged in a regularly spaced grid such that each signal contact 226 is separated from the closest neighboring or adjacent signal contacts 226 in the first direction 256 by a first spacing dimension 926. Similarly each signal contact 226 may be separated from the closest neighboring signal contacts 226 in the second direction 258 by a second spacing dimension 928. The first and second spacing dimensions 926, 928 may be approximately the same or may differ from one another. The first and second spacing dimensions 926, 928 may be varied to adjust the electrical impedance characteristic of the header assembly 102 (shown in FIG. 1), as described above. As described above and below, the arrangement and spacing of the signal contacts 226 in each of the third and fourth sets 234, 236 may be adjusted to emulate a coaxial connection with the signal contacts 226. Examples of various arrangements and spacings of the signal contacts 226 in the sets 234, 236 are provided below in connection with FIGS. 7 through 10.

Figure 4:
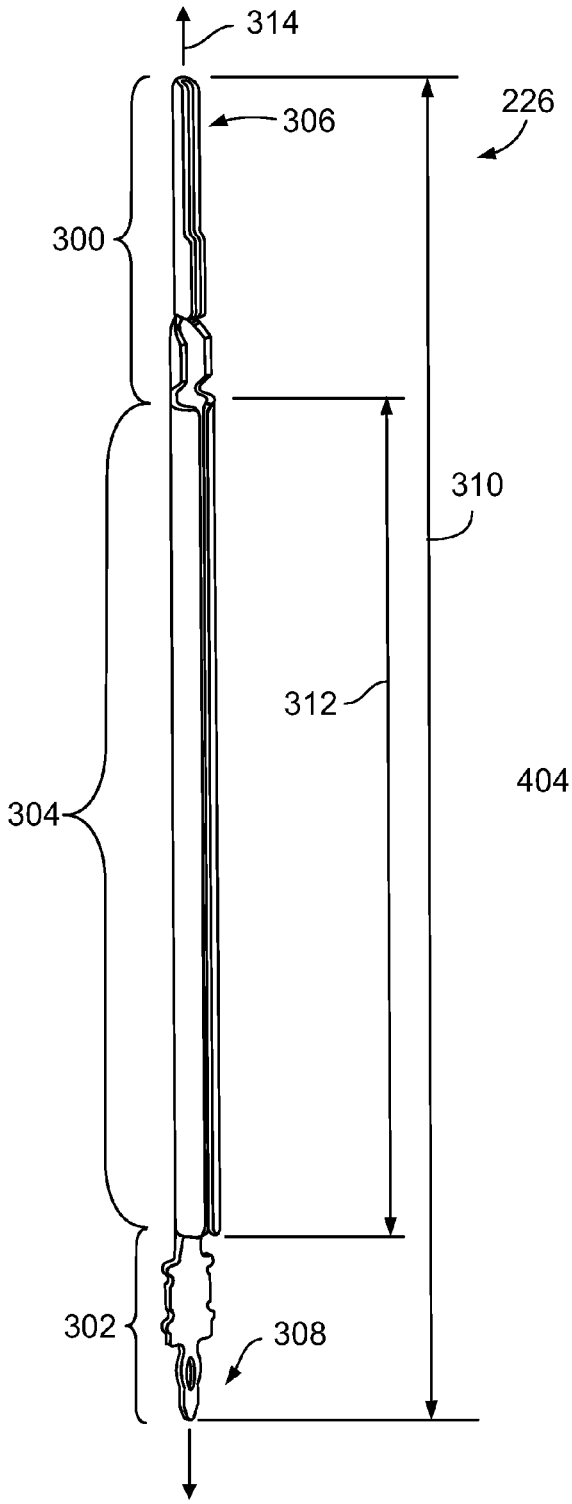
FIG. 4 is a perspective view of a signal contact shown in FIG. 2 according to one embodiment.

FIG. 4 is a perspective view of the signal contact 226 according to one embodiment. The signal contact 226 includes a signal mating end 300 coupled to a signal mounting end 302 by a signal contact body 304. The signal contact 226 has an elongated shape oriented along a longitudinal axis 314. The signal mating and mounting ends 300, 302 extend from the signal contact body 304 in opposing directions along the longitudinal axis 314. The signal contact 226 includes, or is formed from, a conductive material. For example, the signal contact 226 may be stamped and formed from a sheet of metal. Alternatively, the signal contact 226 may be formed from a dielectric material with at least a portion of the signal contact 226 plated with a conductive material.

The signal mating end 300 protrudes from the contact organizer 202 (shown in FIG. 2) of the header assembly 102 (shown in FIG. 1). The signal mating end 300 mates with the mating connector 108 (shown in FIG. 1). Alternatively, the signal mating end 300 mates with the daughter board 106 (shown in FIG. 1). The signal mating end 300 includes a mating pin 306 that is received by a corresponding contact (not shown) in the mating connector 108 or the daughter board 106. In another embodiment, the signal mating end 300 includes a receptacle that receives the corresponding contact in the mating connector 108 or daughter board 106. The signal mating end 300 is electrically connected with at least one of the conductive pathways 118 (shown in FIG. 1) in the daughter board 106 when the signal mating end 300 is mated with the mating connector 108 or the daughter board 106.

The signal mounting end 302 protrudes from the mounting interface 204 (shown in FIG. 2) of the header assembly 102 (shown in FIG. 1). The signal mounting end 302 is mounted to the motherboard 104 (shown in FIG. 1). The signal mounting end 302 includes a mounting pin 308 that is loaded into a cavity (not shown) in the motherboard 104. For example, the mounting pin 308 may be received by a plated cavity in the motherboard 104 that is electrically connected to at least one of the conductive pathways 120 in the motherboard 104. The signal mounting end 302 is electrically connected with at least one of the conductive pathways 120 in the motherboard 104 when the signal mounting end 302 is mounted to the motherboard 104. As shown in FIG. 4, the signal contact body 304 has a tubular shape, although other shapes are contemplated within the embodiments described herein. The signal contact body 304 is disposed between the signal mating and mounting ends 300, 302.

An overall length 310 of the signal contact 226 can be varied to adjust the stack height 110 (shown in FIG. 1) between the daughter board 106 (shown in FIG. 1) and the motherboard 104 (shown in FIG. 1). For example, if the overall length 310 of the signal contacts 226 loaded into the header assembly 102 (shown in FIG. 1) is increased, the daughter board 106 and the motherboard 104 may be separated by an increased distance. Alternatively, a length 312 of the signal contact body 304 can be varied to change the overall length 310 of the signal contact 226. Adjusting the overall length 310 and/or the length 312 of the signal contact body 304 provides an operator of the header assembly 102 with the ability to select a desired stack height 110 between the daughter board 106 and the motherboard 104. For example, if an operator wants the daughter board 106 and the motherboard 104 to be separated by a greater stack height 110, then the operator can select signal contacts 226 with a greater overall length 310 and/or length 312 of the signal contact body 304. In another example, if the operator wants the daughter board 106 and the motherboard 104 to be separated by a lesser stack height 110, then the operator can select signal contacts 226 with a lesser overall length 310 and/or length 312 of the signal contact body 304.

Figure 5:
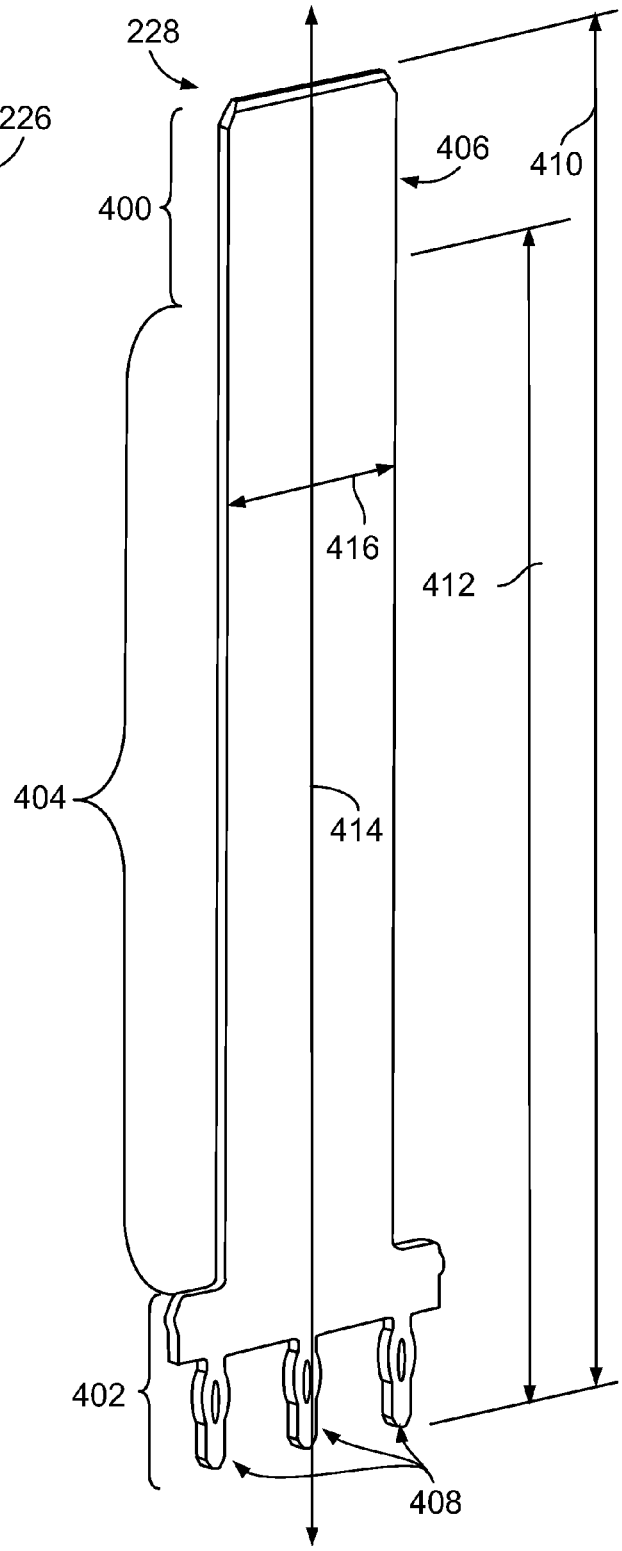
FIG. 5 is a perspective view of a power contact shown in FIG. 2 according to one embodiment.

FIG. 5 is a perspective view of the power contact 228 according to one embodiment. The power contact 228 includes a power mating end 400 coupled to a power mounting end 402 by a power contact body 404. The power contact 228 has an elongated shape oriented along a longitudinal axis 414. The power mating and mounting ends 400, 402 extend from the power contact body 404 in opposing directions along the longitudinal axis 414. The power contact 228 includes, or is formed from, a conductive material. For example, the power contact 228 may be stamped and formed from a sheet of metal.

The power mating end 400 protrudes from the contact organizer 202 (shown in FIG. 2) of the header assembly 102 (shown in FIG. 1). The power mating end 400 mates with the mating connector 108 (shown in FIG. 1). Alternatively, the power mating end 400 mates with the daughter board 106 (shown in FIG. 1). The power mating end 400 includes a mating blade 406 that is received by a corresponding contact (not shown) in the mating connector 108 or the daughter board 106. In another embodiment the power mating end 400 has a shape other than that of a blade. For example, the power mating end 400 may include a mating pin. The power mating end 400 optionally may include a receptacle that receives the corresponding contact in the mating connector 108 or daughter board 106. The power mating end 400 is electrically connected with at least one of the conductive pathways 118 (shown in FIG. 1) in the daughter board 106 when the power mating end 400 is mated with the mating connector 108 or the daughter board 106.

The power mounting end 402 is mounted to the motherboard 104 (shown in FIG. 1). The power mounting end 402 includes mounting pins 408 that are loaded into cavities (not shown) in the motherboard 104. For example, the mounting pins 408 may be received by a plated cavity in the motherboard 104 that is electrically connected to at least one of the conductive pathways 120 in the motherboard 104. While three mounting pins 408 are shown in FIG. 4, a different number of mounting pins 408 may be provided. The power mounting end 402 is electrically connected with at least one of the conductive pathways 120 in the motherboard 104 when the power mounting end 402 is mounted to the motherboard 104. The power contact body 404 is disposed between the power mating and mounting ends 400, 402.

The power contact body 404 has an outside width 416 in a direction transverse to the longitudinal axis 414. For example, the power contact body 404 has a width 416 in a direction perpendicular to the longitudinal axis 414 such that the power contact body 404 has a planar shape in a plane defined by the longitudinal axis 414 and the width 416 of the power contact body 404. The planar shape of the power contact body 404 may be continued in the power mating end 400 and/or the power mounting end 402 as shown in the illustrated embodiment. Alternatively, the shape of the power contact body 404 may differ from the shape of the power mating end 400 and/or the power mounting end 402. The power contact body 404 may be larger than the signal contact body 304 (shown in FIG. 4) to permit the power contact body 404 to communicate a greater electric current than the signal contact body 304.

An overall length 410 of the power contact 228 can be varied to adjust the stack height 110 (shown in FIG. 1) between the daughter board 106 (shown in FIG. 1) and the motherboard 104 (shown in FIG. 1). For example, if the overall length 410 of the power contacts 228 loaded into the header assembly 102 (shown in FIG. 1) is increased, the daughter board 106 and the motherboard 104 may be separated by an increased distance. Alternatively, a length 412 of the power contact body 404 can be varied to change the overall length 410 of the power contact 228. Adjusting the overall length 410 and/or the length 412 of the power contact body 404 provides an operator of the header assembly 102 with the ability to select a desired stack height 110 between the daughter board 106 and the motherboard 104. For example, if an operator wants the daughter board 106 and the motherboard 104 to be separated by a greater stack height 110, then the operator can select power contacts 228 with a greater overall length 410 and/or length 412 of the power contact body 404. In another example, if the operator wants the daughter board 106 and the motherboard 104 to be separated by a lesser stack height 110, then the operator can select power contacts 228 with a lesser overall length 410 and/or length 412 of the power contact body 404.

Figure 6:
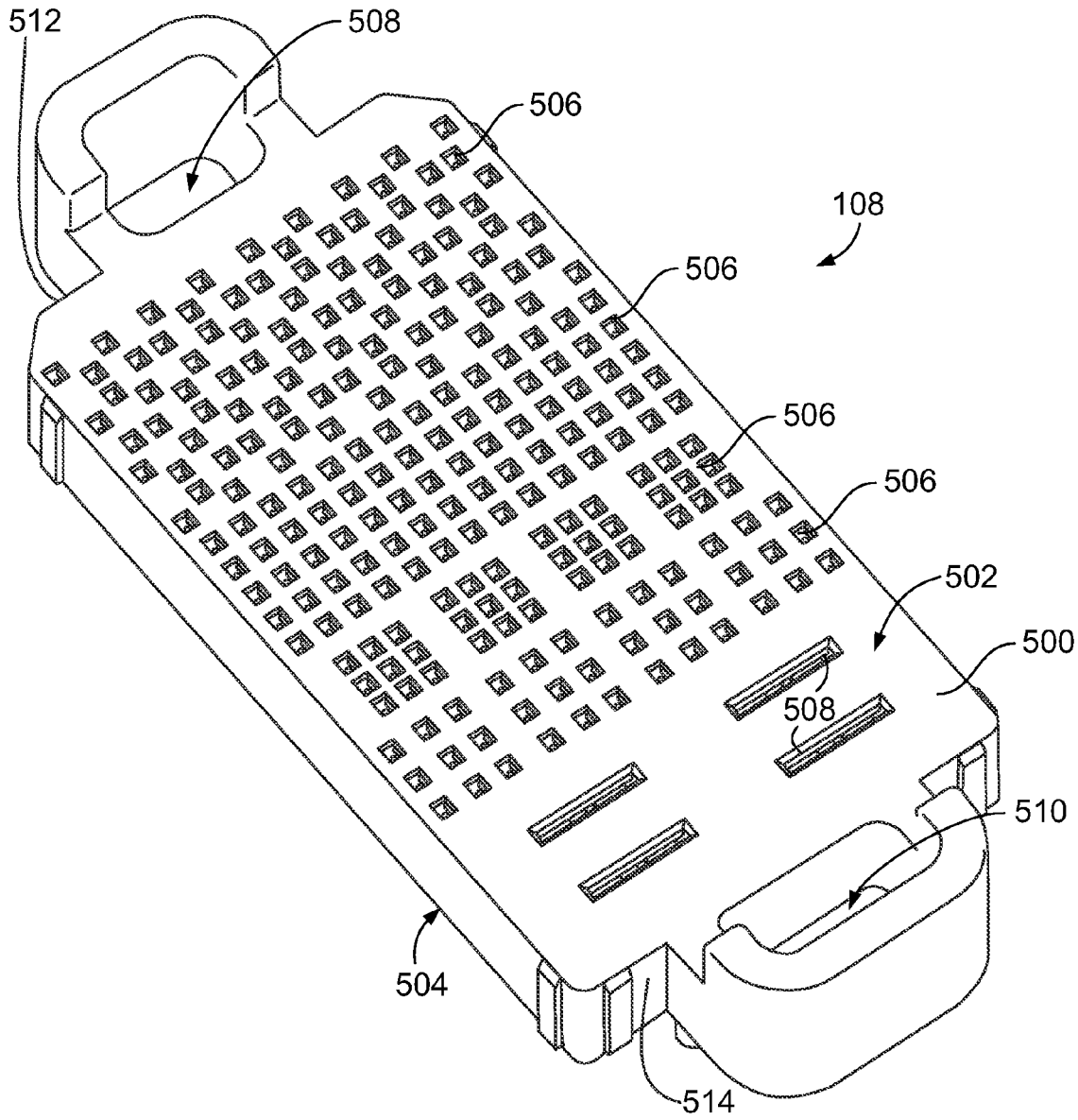
FIG. 6 is a perspective view of a mating connector shown in FIG. 1.

FIG. 6 is a perspective view of the mating connector 108. The mating connector 108 includes a housing 500 that extends between a mating interface 502 and a mounting interface 504. The housing 500 may be homogeneously formed as a unitary body. In one embodiment, the housing 500 is formed of, or includes, a dielectric material. The mating interface 502 engages the mating face 250 (shown in FIG. 2) and the contact organizer 202 (shown in FIG. 2) of the header assembly 102 (shown in FIG. 1) when the mating connector 108 and the header assembly 102 mate with one another. The mounting interface 504 engages the daughter board 106 (shown in FIG. 1) when the mating connector 108 is mounted to the daughter board 106. The mating connector 108 includes a plurality of cavities 506 and slots 516 that are configured to receive the signal and power contacts 226, 228 (shown in FIG. 2), respectively. Mating contacts (not shown) may be held in the cavities 506 and slots 516. The mating contacts may electrically connect with the signal and power contacts 226, 228 when the mating connector 108 and the header assembly 102 mate with one another. Alternatively, the mating contacts in the cavities 506 and slots 516 may be received by the signal and power contacts 226, 228 when the mating connector 108 and the header assembly 102 mate with one another.

The polarization slots 508, 510 are disposed proximate to opposing ends 512, 514 of the housing 500. As described above, the polarization slot 508 is shaped to receive the polarization feature 220 (shown in FIG. 2) of the header assembly 102 (shown in FIG. 1) and the polarization slot 510 is shaped to receive the polarization feature 222 (shown in FIG. 2) of the header assembly 102 to align the mating connector 108 and the header assembly 102 with respect to one another. The cavities 506 and slots 516 in the housing 500 are arranged to match up with and receive the signal and power contacts 226, 228 when the polarization features 220, 222 are received by the slots 508, 510.

Figure 7:
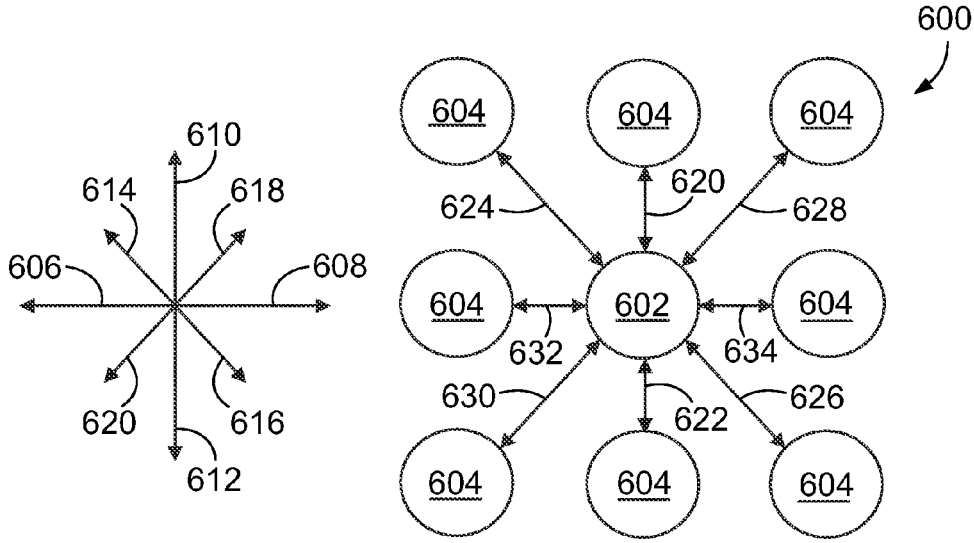
FIG. 7 is a schematic view of an example arrangement of the signal contacts shown in FIG. 2 in one or more groups also shown in FIG. 2.

FIG. 7 is a schematic view of an example arrangement 600 of the signal contacts 226 (shown in FIG. 2) in one or more of the groups 240, 242 (shown in FIG. 2). The arrangement 600 illustrates the locations of signal contacts 226 in one or more of the groups 240, 242 in order for the group 240, 242 to emulate a coaxial connection. The arrangement 600 includes a center location 602 with a plurality of ground locations 604 disposed around the center location 602. One signal contact 226 may be disposed at the center location 602 with a plurality of signal contacts 226 disposed at the ground locations 604 around the periphery of the center location 602. In operation, the signal contact 226 in the center location 602 in the groups 240, 242 communicates a data signal. For example, the signal contact 226 in the center location 602 (referred to as the center signal contact 226) may communicate a signal in a manner that is similar to the center conductor in a coaxial cable connector. The signal contacts 226 disposed in the ground locations 604 are electrically connected to an electric ground. For example, the signal contacts 226 may be electrically connected to an electric ground of the motherboard 104 (shown in FIG. 1). The signal contacts 226 in the ground locations 604 may provide a ground reference and reduce coupled electrical noise for the center signal contact 226. For example, the signal contacts 226 in the ground locations 604 may emulate the shield in a coaxial cable connector. While eight ground locations 604 are shown in the illustrated embodiment a different number of ground locations 604 may be used. Moreover, while the discussion herein focuses on the signal contacts 226 being disposed at the center location 602 and ground locations 604, the cavities 506 (shown in FIG. 5) in the mating connector 108 (shown in FIG. 1) may be arranged in a manner similar to the signal contacts 226. For example, the cavities 506 may be arranged in the arrangement 600 such that the cavities 506 may mate with the signal contacts 226.

In the illustrated embodiment the ground locations 604 are arranged in a polygon shape, such as a square or rectangle, around the center location 602. The ground locations 604 may immediately surround the center location 602 such that all locations or contacts that are adjacent to the center location 602 are ground locations 604. For example, ground locations 604 may be disposed in the locations adjacent to the center location 602 in horizontal directions 606, 608 from the center location 602, in transverse directions 610, 612 from the center location 602, and in diagonal directions 614-620 from the center location 602. In the illustrated embodiment, the horizontal directions 606, 608 are perpendicular to the transverse directions 610, 612 and the diagonal directions 614, 616 are perpendicular to the diagonal directions 618, 620. Grounded signal contacts 226 may be provided at the ground locations 604 such that the signal contacts 226 at the ground locations 604 are the closest signal contacts 226 to the signal contact 226 in the center location 602 in each of the directions 610-620. The signal contacts 226 used to communicate a data signal may only have signal contacts 226 connected to an electrical ground disposed in all adjacent locations to the signal contact 226. For example, where the arrangement 600 is repeated multiple times as shown in sets 234, 236 in FIG. 2, no two signal contacts 226 in the center location 602 are adjacent to one another.

As described above, the signal contacts 226 in the arrangement 600 may emulate a coaxial connector. The impedance of the coaxial connector that is emulated by the signal contacts 226 may be varied by changing the separation between the signal contacts 226 in the directions 606-620. The signal contact 226 in the center location 602 is separated from the grounded signal contacts 226 in the ground locations 604 by separation dimensions 620-634. For example, the center location 602 may be separated from the ground locations 604 along the direction 606 by the separation dimension 632, along the direction 608 by the separation dimension 634, along the direction 610 by the separation dimension 620, along the direction 612 by the separation dimension 622, along the direction 614 by the separation dimension 624, along the direction 616 by the separation dimension 626, along the direction 618 by the separation dimension 628, and along the direction 620 by the separation dimension 630. In one embodiment the separation dimensions 620-634 are approximately the same. One or more of the separation dimensions 620-634 may be varied to adjust or change the electrical impedance characteristic of the coaxial connection that is emulated by the signal contacts 226 provided in the arrangement 600. For example, increasing the separation dimensions 620-634 between the signal contacts 226 in the directions 606-620 may increase the electrical impedance of the coaxial connector that is emulated by the signal contacts 226 in the arrangement 600. In the embodiment shown in FIG. 2, the coaxial connections that are emulated by the signal contacts 226 in the groups 242 of the fourth set 236 have a greater electrical impedance characteristic than the coaxial connections emulated by the signal contacts 226 in the groups 240 of the third set 234. Alternatively, reducing the separation dimensions 620-634 between the signal contacts 226 in the directions 606-620 may decrease the electrical impedance of the coaxial connector that is emulated by the signal contacts 226 in the arrangement 600

Figure 8:
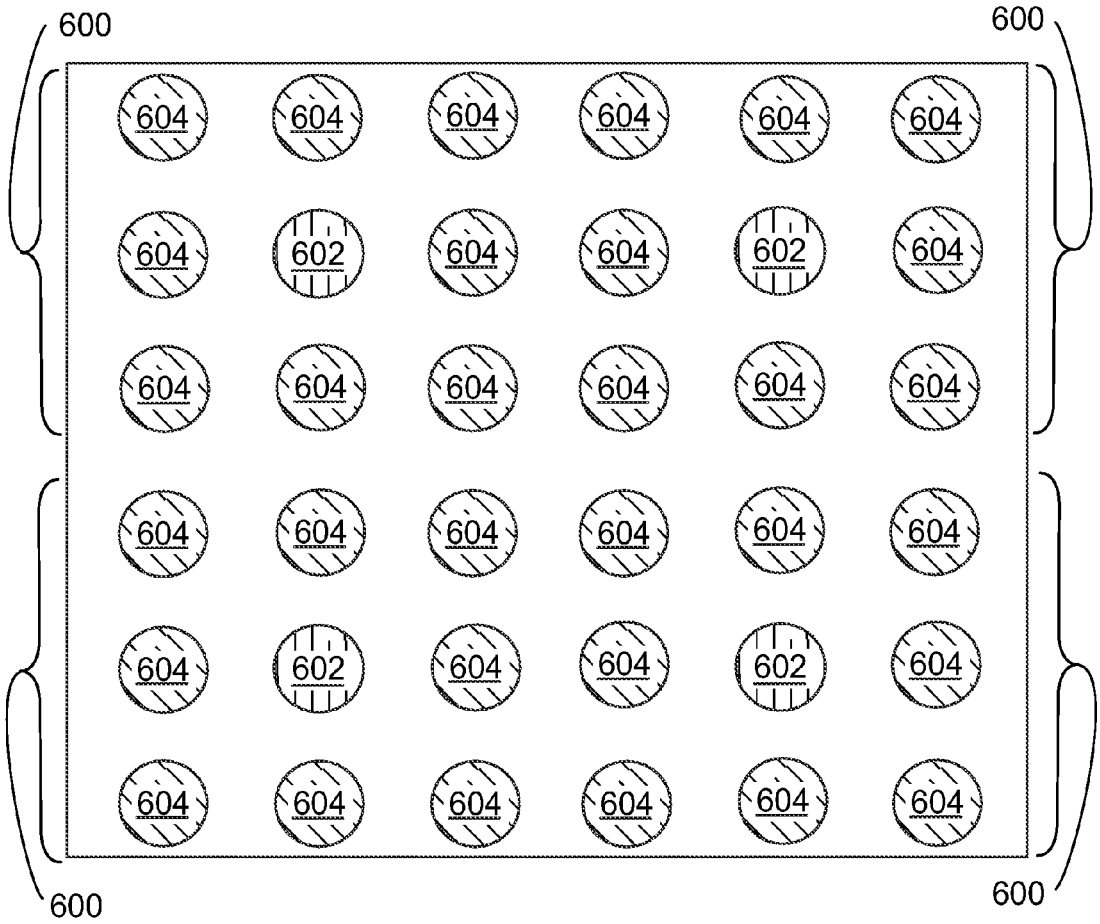
FIG. 8 is a schematic illustration of a plurality of the arrangements of the signal contacts shown in FIG. 7 according to an example embodiment.

FIG. 8 is a schematic illustration of a plurality of the arrangements 600 of the signal contacts 226 (shown in FIG. 2) according to an example embodiment. The ground locations 604 in each arrangement 600 are dedicated to the center location 602 in that arrangement 600. For example, the signal contacts 226 disposed in the dedicated ground locations 604 provide EMI shielding for the signal contact 226 located in the center location 602 of each arrangement 600. As shown in FIG. 7, the ground locations 604 in each arrangement 600 are not associated with or included in the ground locations 604 of any adjacent arrangement 600. For example, each ground location 604 is adjacent to only a single center location 602. As a result, the signal contacts 226 disposed in the ground locations 604 also are dedicated ground contacts for the signal contact 226 disposed in the center location 602 for each arrangement 600. As described above, while the discussion here focuses on the signal contacts 226, the cavities 506 may be disposed in the center and dedicated ground locations 602, 604 shown in FIG. 8.

Figure 9:
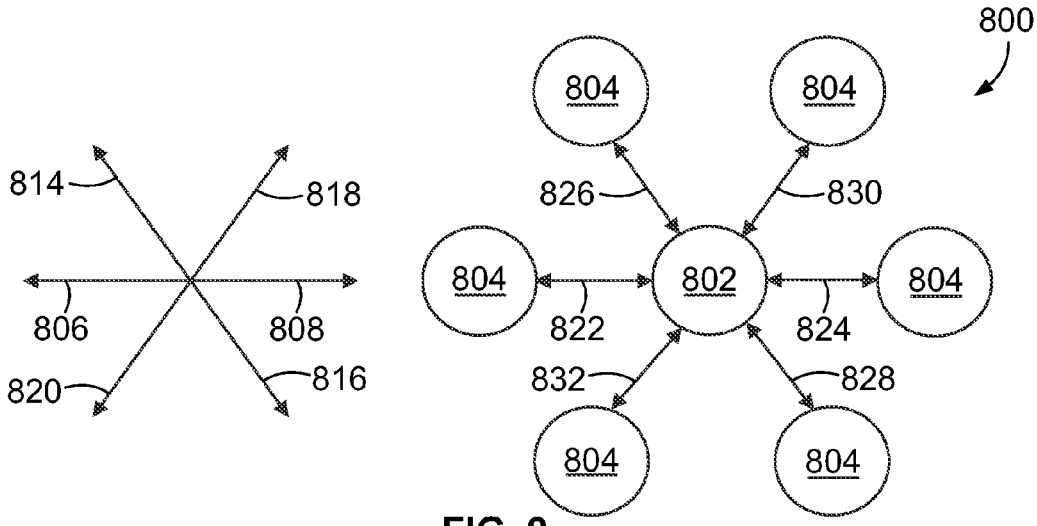
FIG. 9 is a schematic view of an example arrangement of the signal contacts shown in FIG. 2 in one or more of the groups shown in FIG. 2 according to an alternative embodiment.

FIG. 9 is a schematic view of an example arrangement 800 of the signal contacts 226 (shown in FIG. 2) in one or more of the groups 240, 242 (shown in FIG. 2) according to an alternative embodiment. The arrangement 800 illustrates the locations of signal contacts 226 in one or more of the groups 240, 242 in order for the group 240, 242 to emulate a coaxial connection. The arrangement 800 includes a center location 802 with a plurality of ground locations 804 disposed around the center location 802. In the illustrated embodiment the ground locations 804 are arranged in a hexagonal shape around the center location 802. Alternatively, the ground locations 804 may be in a shape other than a hexagon. One signal contact 226 may be disposed at the center location 802 with a plurality of signal contacts 226 disposed at the ground locations 804 around the periphery of the center location 802.

The ground locations 804 may immediately surround the center location 802 such that all locations or contacts that are adjacent to the center location 802 are ground locations 804. For example, ground locations 804 may be disposed in the locations adjacent to the center location 802 in horizontal directions 806, 808 from the center location 802 and in diagonal directions 814-820 from the center location 802. In the illustrated embodiment, the diagonal directions 814, 816 are perpendicular to the diagonal directions 818, 820. Grounded signal contacts 226 may be provided at each of the ground locations 804 such that the signal contacts 226 at the ground locations 804 are the closest signal contacts 226 to the signal contact 226 in the center location 802 in each of the directions 806-820. The signal contacts 226 used to communicate a data signal may only have signal contacts 226 connected to an electrical ground disposed in all adjacent locations to the signal contact 226. For example, where the arrangement 800 is repeated multiple times as shown in sets 234, 236 in FIG. 2, no two signal contacts 226 in the center location 802 are adjacent to one another.

In operation, the signal contact 226 in the center location 802 in the groups 240, 242 communicates a data signal. For example, the signal contact 226 in the center location 802 (referred to as the center signal contact 226) may communicate a signal in a manner similar to the center conductor in a coaxial cable connector. The signal contacts 226 disposed in the ground locations 804 are electrically connected to an electric ground. For example, the signal contacts 226 may be electrically connected to an electric ground of the motherboard 104 (shown in FIG. 1). The signal contacts 226 in the ground locations 804 may provide EMI shielding for the center signal contact 226. For example, the signal contacts 226 in the ground locations 804 may emulate the shield in a coaxial cable connector. While six ground locations 804 are shown in the illustrated embodiment, a different number of ground locations 804 may be used. Moreover, while the discussion herein focuses on the signal contacts 226 being disposed at the center location 802 and ground locations 804, the cavities 506 (shown in FIG. 5) in the mating connector 108 (shown in FIG. 1) may be arranged in a manner similar to the signal contacts 226. For example, the cavities 506 may be arranged in the arrangement 800 such that the cavities 506 may mate with the signal contacts 226.

As described above, the signal contacts 226 in the arrangement 800 may emulate a coaxial connector. The impedance of the coaxial connector that is emulated by the signal contacts 226 may be varied by changing the separation between the signal contacts 226 in the directions 806-820. The signal contact 226 in the center location 802 is separated from the grounded signal contacts 226 in the ground locations 804 by separation dimensions 822-832. For example, the center location 802 may be separated from the ground locations 804 along the direction 806 by the separation dimension 822, along the direction 808 by the separation dimension 824, along the direction 814 by the separation dimension 826, along the direction 816 by the separation dimension 828, along the direction 818 by the separation dimension 830, and along the direction 820 by the separation dimension 832. In one embodiment, the separation dimensions 822-832 are approximately the same. One or more of the separation dimensions 822-832 may be varied to change the electrical impedance characteristic of the coaxial connection that is emulated by the signal contacts 226 provided in the arrangement 600. For example, increasing the separation dimensions 822-832 between the signal contacts 226 in the directions 806-820 may increase the electrical impedance of the coaxial connector that is emulated by the signal contacts 226 in the arrangement 800. Alternatively, reducing the separation between the signal contacts 226 in the directions 806-820 may decrease the impedance of the coaxial connector that is emulated by the signal contacts 226 in the arrangement 800.

Figure 10:
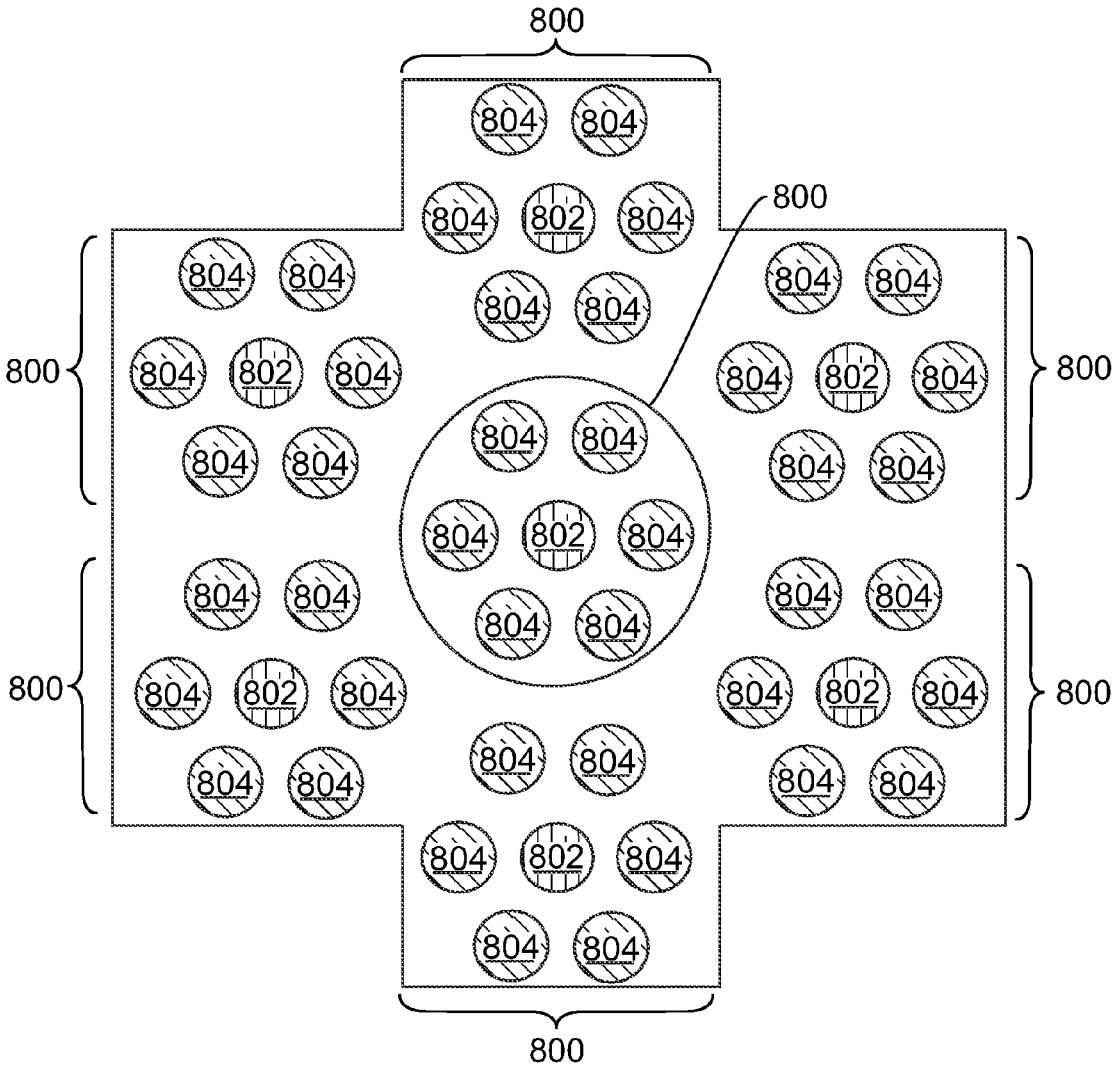
FIG. 10 is a schematic illustration of a plurality of the arrangements of the signal contacts shown in FIG. 9 according to an example embodiment.

FIG. 10 is a schematic illustration of a plurality of the arrangements 800 of the signal contacts 226 (shown in FIG. 2) according to an example embodiment. The ground locations 804 in each arrangement 800 are dedicated to the center location 802 in that arrangement 600. For example, the signal contacts 226 disposed in the dedicated ground locations 804 provide EMI shielding for the signal contact 226 located in the center location 802 in each arrangement 800. As shown in FIG. 9, the ground locations 804 in each arrangement 800 are not associated with or included in the ground locations 804 of any adjacent arrangement 800. For example, each ground location 804 is adjacent to only a single center location 802. As a result, the signal contacts 226 disposed in the ground locations 804 also are dedicated ground contacts for the signal contact 226 disposed in the center location 802 for each arrangement 800. As described above, while the discussion here focuses on the signal contacts 226, the cavities 506 may be disposed in the center and dedicated ground locations 802, 804 shown in FIG. 9.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing for mating with a mating connector to couple first and second circuit boards with each other; and substantially similar contacts arranged in differential pairs in first, second, and third set in the housing and configured to electrically couple with the mating connecter, the contacts in the first set separated by a first inter-contact separation distance and the contacts in the second set separated by a different second inter-contact separation distance, the first and second inter-contact separation distances being arranged to communicate different speeds of differential data signals with the mating connector, the contacts in the third set arranged to emulate a coaxial connection with the mating connector.

2. The assembly of claim 1, wherein the contacts in the first and second sets comprise substantially identical pins.

3. The assembly of claim 1, wherein the first and second sets of contacts concurrently communicate the differential data signals at the different speeds.

4. The assembly of claim 1, wherein the coaxial connection is a first coaxial connection, further comprising a fourth set of the contacts, the contacts in the fourth set arranged to emulate a second coaxial connection having a smaller electrical impedance characteristic than the first coaxial connection.

5. The assembly of claim 4, wherein the contacts in the third set are separated from each other by a greater inter-contact separation distance than the contacts in the fourth set.

6. The assembly of claim 1, wherein at least one of the first and second sets of contacts includes signal contacts and ground contacts, the signal contacts arranged in the differential pairs, the ground contacts aligned with each other in a ring that encircles the differential pairs of the signal contacts and configured to electrically couple with a ground reference.

7. The assembly of claim 1, wherein at least one of the sets of contacts includes contacts arranged in a regularly spaced grid.

8. The assembly of claim 1, wherein the housing mechanically couples the mating connector with a circuit board to communicate the differential data signals between the mating connector and the circuit board.

9. The assembly of claim 1, wherein the mating connector is coupled with a first circuit board and the housing is configured to mechanically couple the first circuit board with a second circuit board in a parallel relationship.

* * * * *